US006419124B1

(12) United States Patent
Hennemann et al.

(10) Patent No.: US 6,419,124 B1
(45) Date of Patent: Jul. 16, 2002

(54) LIQUID SPRAYER

(75) Inventors: Pascal Hennemann; Jean-Pierre Alleard, both of Eu; David Leuliet, Mers les Bains, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/744,243

(22) PCT Filed: Jul. 30, 1999

(86) PCT No.: PCT/FR99/01890

§ 371 (c)(1),
(2), (4) Date: Jan. 30, 2001

(87) PCT Pub. No.: WO00/07740

PCT Pub. Date: Feb. 17, 2000

(30) Foreign Application Priority Data

Jul. 31, 1998 (FR) ..... 98 09853

(51) Int. Cl.[7] ..... B65D 88/54

(52) U.S. Cl. ..... 222/321.6; 222/321.8; 222/162; 251/347

(58) Field of Search ..... 222/321.1, 321.6, 222/321.7, 321.8, 321.9, 398, 383.1, 385, 162; 251/347

(56) References Cited

U.S. PATENT DOCUMENTS 3,323,690 A * 6/1967 Monahon ..... 222/402.13
5,971,226 A * 10/1999 Goncalves ..... 222/321.6

* cited by examiner

*Primary Examiner*—Lesley D. Morris
*Assistant Examiner*—Melvin A. Cartagena
(74) *Attorney, Agent, or Firm*—Bacon & Thomas, PLLC

(57) ABSTRACT

A liquid dispenser of the type comprising a tank (R) fitted with liquid extractor means (P) suitable for being actuated by axial displacement of the tank relative to a delivery tube (T) having a portion that projects outwards, the dispenser being characterized in that it comprises firstly a discharge duct (1) connected in leakproof manner to the outer portion of the delivery tube (T) and passing through an endpiece (2) connected rigidly to a housing (B) containing the tank (R), and secondly at least one side knob (11, 12) engaging the tank or the delivery tube and carrying a cam (110, 120) designed to co-operate in sliding contact with at least one sloping wall (21, 22) secured to said endpiece (2) in such a manner that substantially radial thrust on said knob (11, 12) is transformed into axial displacement of the tube (T) relative to the tank (R), thereby causing the liquid to be dispensed.

9 Claims, 5 Drawing Sheets

LIQUID SPRAYER

BACKGROUND OF THE INVENTION

The present inventions relates to a liquid dispenser and more particularly to a dispenser of liquid pharmaceuticals that are to be delivered by spraying or by jet.

There already exist liquid dispensers of the type comprising in particular a tank fitted with liquid-extractor means such as a valve or a pump having a dispenser head mounted thereon.

The extractor means are suitable for being actuated by moving the tank axially relative to a delivery tube which is fed by the extractor means and which has a portion that projects outside and that is covered by said head.

Nevertheless, for certain pharmaceuticals such as homeopathic or ophthalmic liquids, for example, the doses to be administered correspond to volumes that are very small, of the order of 30 microliters ($\mu$l) to 50 $\mu$l.

Under such conditions, the liquid is packaged in tanks constituted by small-content flasks which are therefore of small size, thus making them difficult to use.

In particular, the head covering the spray tube is then of small dimensions which are ill-suited to the numerous handling operations which are nevertheless required in order to obtain axial displacement of the delivery tube.

SUMMARY OF THE INVENTION

An object of the present invention is to resolve those technical problems by providing packaging which is easier to handle, and to do so independently of the size of the doses of liquid that are to be dispensed.

According to the invention, this object is achieved by means of a dispenser of the above type characterized in that it comprises firstly a discharge duct connected in leakproof manner to the outer portion of the delivery tube and passing through an endpiece connected rigidly to a housing containing the tank, and secondly at least one side knob engaging the tank or the delivery tube and carrying a cam designed to co-operate in sliding contact with at least one sloping wall secured to said endpiece in such a manner that substantially radial thrust on said knob is transformed into axial displacement of the tube relative to the tank, thereby causing the liquid to be dispensed.

According to an advantageous characteristic, the tank is enclosed in removable manner inside the housing that is defined at its top end by said endpiece.

According to another characteristic, said knob has a pushbutton-forming outside flank whose generator lines are at least in part parallel with those of the duct.

Preferably, said pushbutton-forming outside flank extends in flush manner in openings formed in the side wall of the housing.

Advantageously, said pushbutton-forming outside flank has fluting.

In a variant, said endpiece is extended downwards by a substantially cylindrical skirt provided at its bottom end with fastener members for fastening to the housing.

In another variant, said housing is provided with a set of two diametrically opposite knobs.

Advantageously, the free end of said duct is provided with a spray nozzle.

Preferably, the duct is connected to said tube by mutual engagement with radial clamping.

In a first embodiment, the tank is held stationary inside the housing while said knob is secured to the tube and said sloping wall slopes towards the bottom of the discharge duct.

In which case, said discharge duct is slidably mounted inside the endpiece while the tank is held stationary in a stand fixed in optionally releasable manner to said housing.

Preferably, said knob is provided with a spacer-forming link arm connected to said duct.

Furthermore, said cam is formed by a bulge carried by the inside flanks of the knob.

In a second embodiment, said knob is secured to the tank which is axially movable inside the housing, while said sloping wall slopes towards the top of the discharge duct.

In which case, said discharge duct is fixedly mounted in the endpiece while the tank slides in an internal bore in the housing.

Preferably, said knob is mounted on the neck of the tank by means of a fastening ring.

Advantageously, said cam is formed by the bottom edge of the outside flank of the knob.

In a particular variant, said sloping walls present faces coming into contact with said cams and having varying slope.

The dispenser of the invention is of highly ergonomic shape and provides flexibility and great comfort in use.

A particularly suitable application lies in the field of spraying cosmetics such as hydrating substances or pharmaceuticals such as nasal solutions.

The dispenser can be adapted equally well to a pressurized tank fitted with a valve or to an atmospheric tank fitted with a pre-compression pump.

The pushbutton-forming side knobs provide control over the extractor means that is easy, reliable, and sensitive, thus enabling the liquid to be dispensed with great accuracy.

Furthermore, the overall appearance is very attractive and looks like a conventional bottle or flask type container.

BRIEF DESCRIPTION OF THE DRAWINGS

The invention will be better understood on reading the following description accompanying by the drawings, in which.

DETAILED DESCRIPTION OF THE INVENTION

The dispenser shown in the figures is designed to deliver successive doses of a liquid contained in a tank.

As shown in FIGS. 1A, 1B, 3A, and 3B, the dispenser is fitted in conventional manner with liquid extracting device which is constituted either by a precompression pump P mounted in this case on the neck of an atmospheric tank R, or else by a valve (not shown) mounted on a tank under pressure.

The extracting device is suitable for being actuated by the user who, for this purpose, exerts manual thrust on a delivery tube 10 fed by the extracting device and has an end portion that projects outside the tank R, which end portion is optionally covered by a dispenser head (not shown).

The thrust can also be exerted on the bottom of the tank R by the user who then holds the tube 10 stationary, such that in all cases there is axial relative displacement of the tube T towards the tank R with said tank being put under pressure.

When the valve of the pump opens, then the liquid can escape to the outside via the tube T which then returns to its initial position under drive from return means (not shown).

In the invention, the external portion of the delivery tube T is connected in leakproof manner to a discharge duct 1. The connection is implemented in this case by the tube T being engaged in the duct 1 with radial clamping. Where appropriate, the bottom end 1*a* of the duct 1 could be provided with an appropriate countersink.

The discharge duct 1 extends the tube T axially through an endpiece 2.

The endpiece 2 is also connected rigidly to a housing B that contains the tank R by means that are described below.

In the embodiments of the figures, the tank R is enclosed inside a housing B whose top portion is defined by the endpiece 2 and whose bottom portion is defined by a bottom-forming stand 3. The housing B is optionally removable so as to enable the housing to be refilled or to enable said tank to be refilled.

Figure 1A:
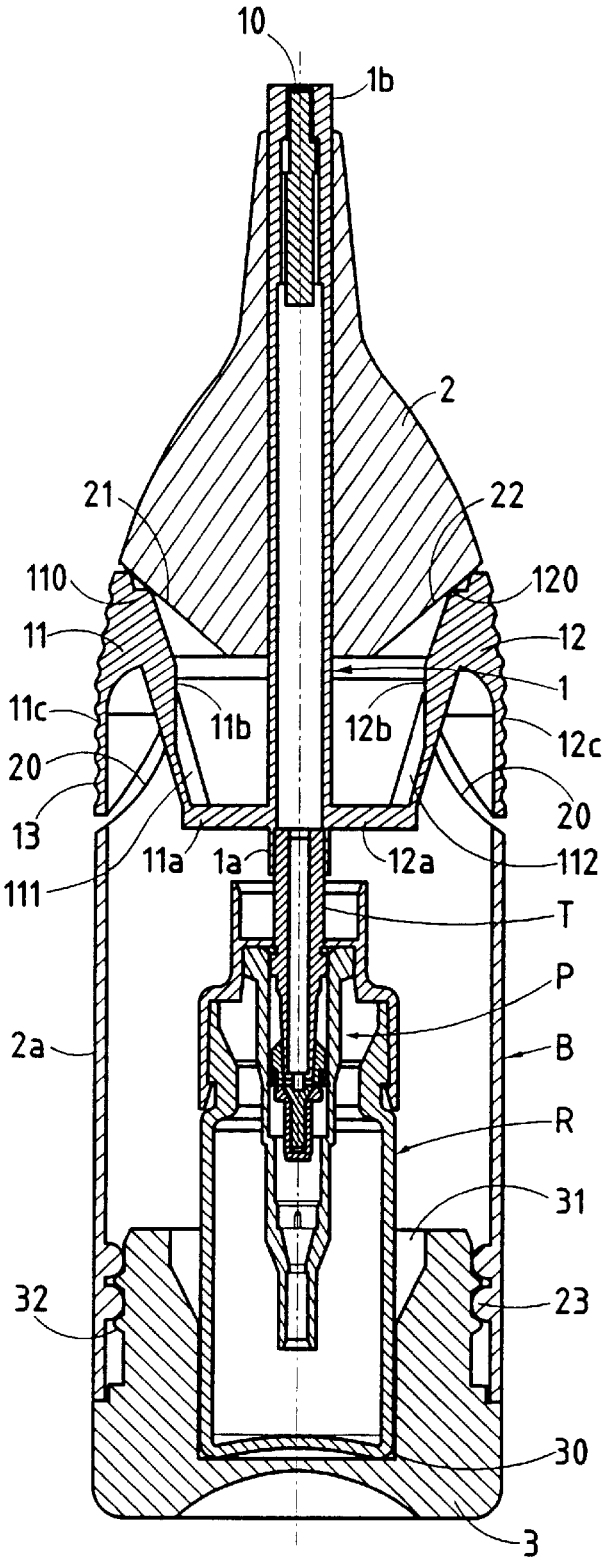
FIGS. 1A and 1B are section views through a first embodiment of a dispenser of the invention shown respectively in a rest position and while dispensing.

In FIGS. 1A and 13, the endpiece 2 is extended downwards by a skirt 2*a* that is substantially cylindrical and provided at its bottom end with fastening members 23 designed to co-operate with complementary members 32 provided on the stand 3 so as to connect the endpiece 2 rigidly to the housing B.

Figure 2A:
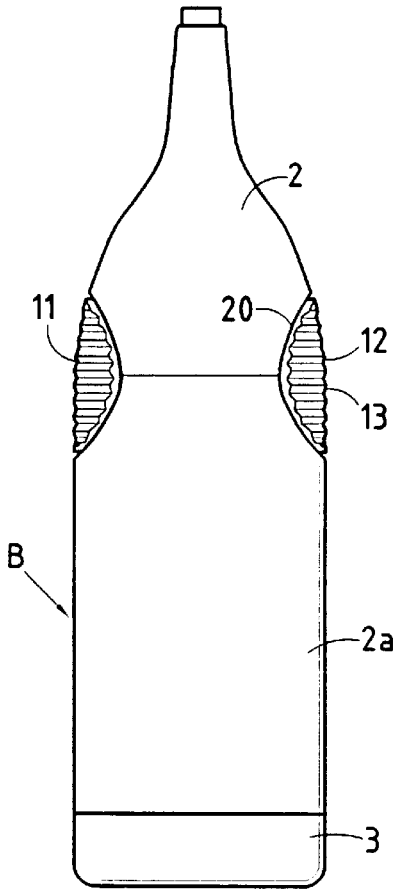
FIGS. 2A and 2B are respectively a front view and a perspective view of the embodiment of FIGS. 1A and 1B.
Figure 2B:
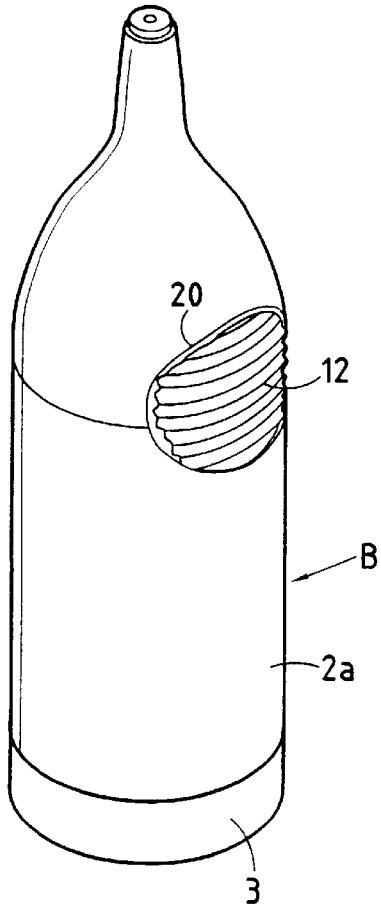

The skirt 2*a* of the endpiece 2 constitutes a portion of the side wall of the housing B and it can be made (FIG. 2B) integrally with the endpiece 2, or else it can be made in the form of a separate piece for assembly thereto (FIG. 2A).

The top end 1*b* of the duct 1 is provided with a spray nozzle 10.

The dispenser of the invention has at least one, and in this case two diametrically opposite knobs 11 and 12.

Each of the knobs 11, 12 is provided with a cam 110, 120 for co-operating in sliding contact with a sloping wall 21, 22 secured to the endpiece 2. These knobs engage either with the delivery tube T as in the embodiment of FIGS. 1A and 1B, or else with the tank R as in the embodiment of FIGS. 3A and 3B.

The length of the sloping walls 21, 22 is adjusted as a function of the stroke needed by the tube T to enable a predetermined dose of liquid to be delivered. The position of the housing B and of the endpiece 2 relative to the tank R or the tube T is maintained by appropriate fastening means providing a rigid connection that suffices to guarantee that the liquid is extracted in accurate doses.

Co-operation between the cams 110, 120 of the knobs 11, 12 and the sloping walls 21, 22 of the endpiece is such that substantially radial thrust on at least one of the knobs causes upward or downward sliding which in turn causes the tube T to move axially closer to the tank R. The relative stroke of the tube T corresponds to actuating the extracting device P in such a manner as to deliver one dose of liquid.

Openings 20 are formed in the side wall of the housing B to receive the knobs 11, 12 with a small amount of clearance relative to their outside flanks 11*c*, 12*c*.

The outside flanks 11*c*, 12*c* extend in the openings 20 so as to be flush with the surrounding wall of the skirt 2*a* so as to avoid creating a discontinuity on the housing and so as to conserve its shape as a body of revolution. The edges of the openings 20 are advantageously chamfered.

The outside flanks 11*c*, 12*c* form pushbuttons and possess generator lines which are parallel at least in part to those of the duct 1.

The visible faces of the flanks 11*c*, 12*c* are preferably provided with fluting 13 to improve manual thrust and avoid any slipping.

Figure 1B:
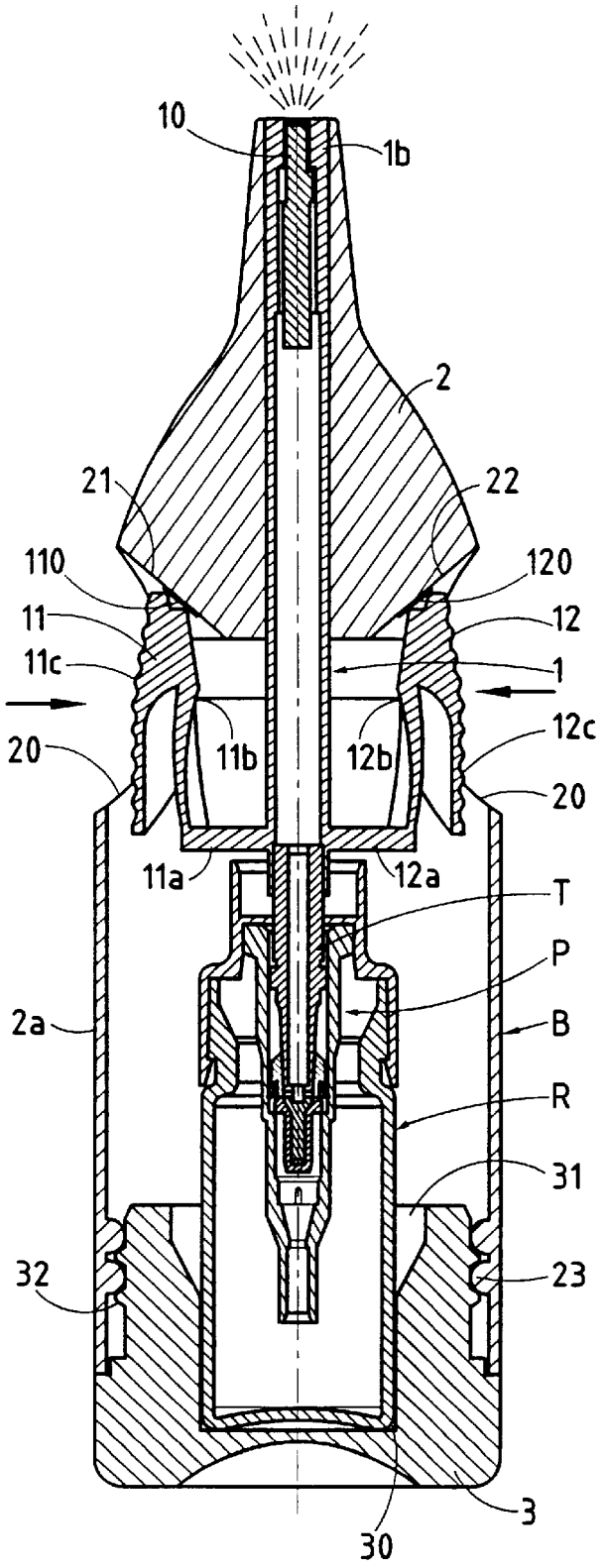

In FIGS. 1A and 1B, the cams 110, 120 are made in the form of projections carried by the top portions of the inside flanks 11*b*, 12*b* of the knobs 11, 12 and the sloping walls 21, 22 slope towards the bottom of the duct 1.

Under such circumstances, the cams are in sliding contact with the bottom faces of the sloping walls.

The knobs 11, 12 are attached to the duct 1 by link arms 11*a*, 12*a* that form spacers and that extend substantially perpendicularly to the side wall of said duct.

Where appropriate, the link arms are integrated in a disk which is mounted coaxially about the duct 1.

The inside flanks 11*b*, 12*b* extend the arms 11*a*, 12*a* upwards and radially away from the duct 1, thereby connecting them with the outside flanks 11*c*, 12*c*.

The inside flanks 11*b*, 12*b* are provided with stiffeners in the form of ribs 111, 112 which nevertheless allow a certain amount of flexibility in deformation to remain.

The duct 1 slides freely in an axial bore formed in the solid endpiece 2 whereas the tank R is held stationary inside the housing B.

The top end 1*b* of the duct 1 projects freely out from the endpiece 2, at least when the dispenser is in the rest position.

The stand 3 has a cylindrical cavity 30 for receiving the tank R and of dimensions that are adjusted for this purpose so as to hold the tank by radial clamping.

To facilitate insertion of the tank R in the stand 3, the cavity 30 is provided with a tapering top mouth 31.

Figure 3A:
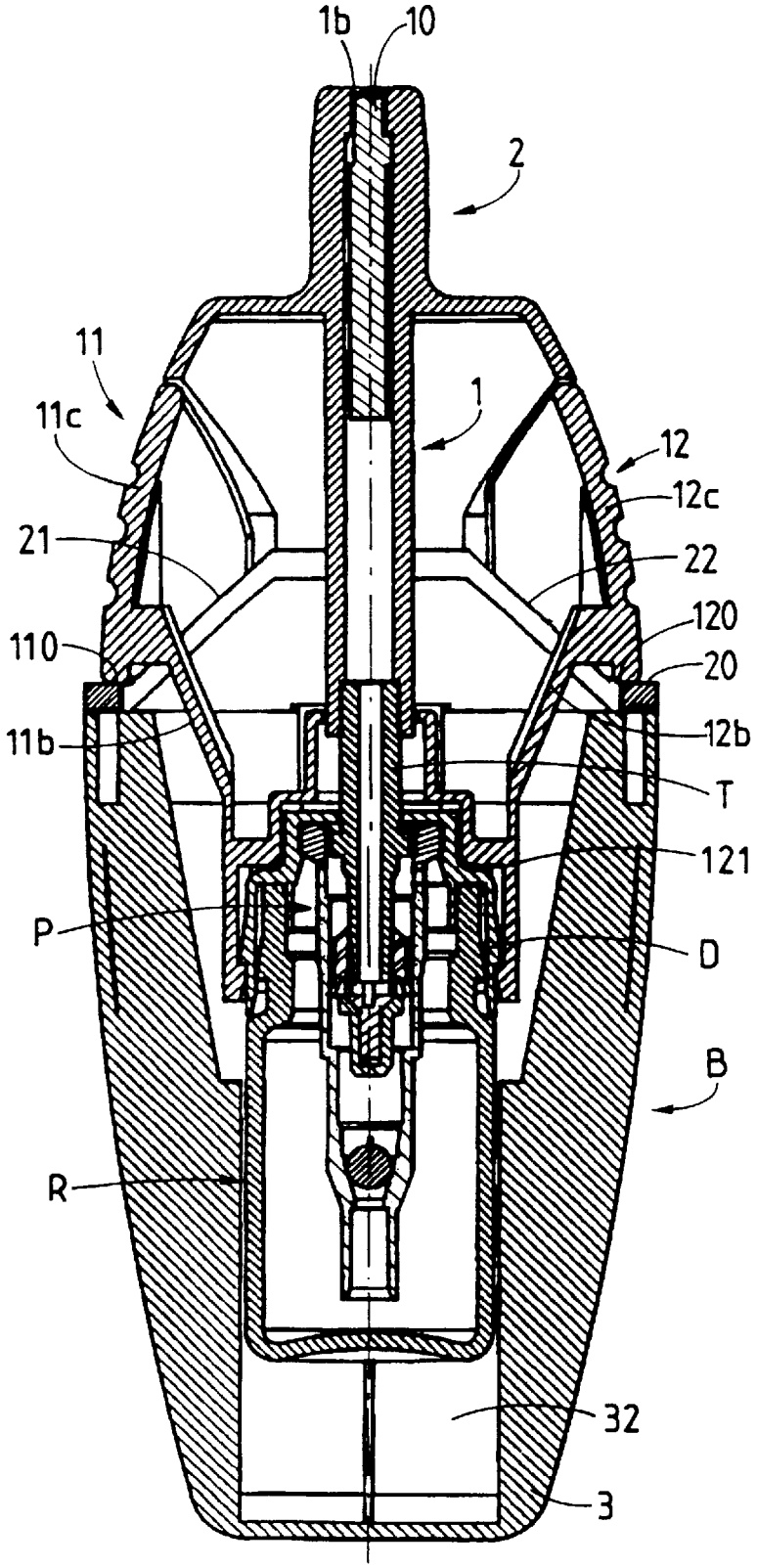
FIGS. 3A and 3B are section views of a second embodiment of the dispenser of the invention respectively in a rest position and while dispensing.
Figure 3B:
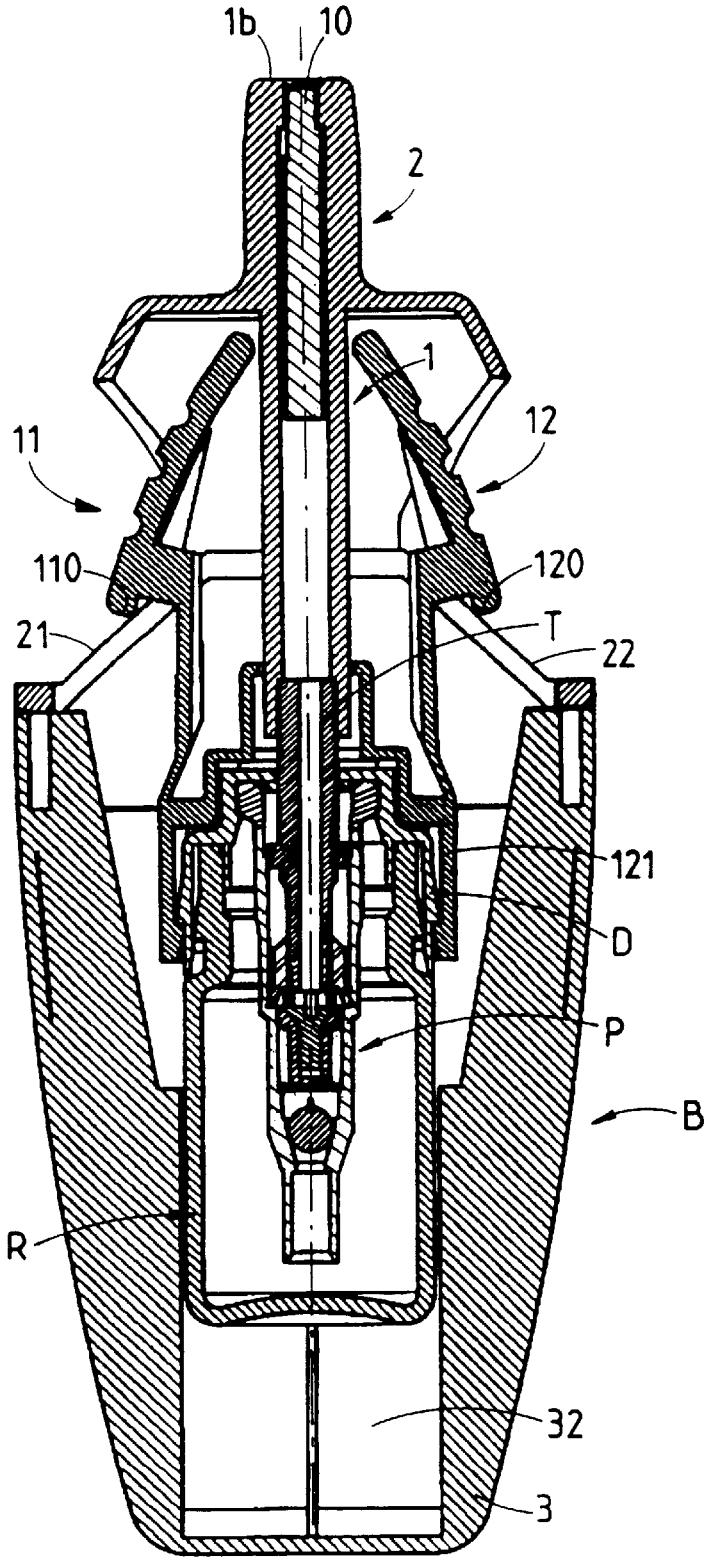

In FIGS. 3A and 3B, the knobs 11, 12 are secured to the tank R which in this case is axially movable inside the housing B while the discharge duct 1 is mounted to be fixed in the endpiece 2 and projects downwards therefrom.

The tank R slides axially in guided manner in an internal bore 32 formed in the stand 3, while the inside flanks 11*b*, 12*b* are subjected to bending towards the axis of the duct 10 under the effect of the radial thrust on the knobs 11, 12 whose outside flanks 11*c*, 12*c* then come to be received inside the endpiece 2.

The sloping walls 21, 22 slope up towards the top of the duct 1 and co-operate, still by sliding, with the bottom edges of the outside flanks 11*c*, 12*c* forming the cams of the knobs 11, 12.

To this end, the bottom edges of the flanks 11*c*, 12*c* are curvilinear in profile, and under such circumstances it is the top faces of the sloping walls 21, 22 that come into sliding contact with the cams.

Each of the sloping walls 21, 22 is made as a plane portion carried by a cone placed between the inner side wall of the housing B and the endpiece 2 and being secured, where appropriate, to the bottom portion of said endpiece.

The contact faces of the sloping walls 21, 22 are optionally of slope that varies along the height thereof in a manner that is discontinuous or continuous (i.e. defining a curve) thus making it possible, for example, for the slope to be shallower in the lower portions thereof corresponding to the beginning of thrust being applied to the knobs 11, 12.

The knobs 11, 12 are mounted on the neck of the tank R by means of a ring 121 secured to the inside flanks 11*b*, 12*b* and secured to the inside flanks 11*b*, 12*b* and fitted, for example, with snap-fastening members for co-operating with complementary members carried by the neck of the tank R or by a bushing D that also serves to lock the extracting device P.

What is claimed is:

1. A liquid dispenser comprising:

a delivery tube extending axially through said liquid dispenser and having an outer portion projecting outwards from said liquid dispenser;

a tank (R) configured with a liquid extracting device (P) operable by axial displacement of the tank (R) relative to said delivery tube (T);

a discharge duct (1) connected in a leakproof manner to the outer portion of the delivery tube (T) and passing through an endpiece (2) rigidly connected to a housing (B) enclosing the tank (R); and at least one side knob (11, 12) secured to said tank (R) and axially movable inside said housing, said at least one side knob carrying a cam (110, 120) cooperating and slidably contacting with at least one sloping wall (21, 22) secured to said endpiece (2) and extending towards a top portion of said discharge duct such that a substantial radial thrust on said knob (11, 12) urges axial displacement of the tube (T) relative to the tank to thereby cause liquid contained in said tank to be dispensed.

2. The dispenser according to claim 1 wherein said discharge duct (1) is fixedly mounted in the endpiece (2), and said tank (R) is slidably mounted in an internal bore (32) defined by said housing (B).

3. The dispenser according to claim 1 wherein said knob (11, 12) is mounted along the neck of the tank (R) with a fastening ring (121).

4. The dispenser according to claim 1 wherein said cam (110, 120) is formed from a bottom edge of an outside flank (11*c*, 12*c*) defined by the knob (11, 12).

5. The dispenser according to claim 1 wherein said sloping walls (21, 22) have faces defining a varying slope communicating with said cams (11), (120).

6. The dispenser according to claim 1 wherein said knob (11, 12) defines a pushbutton-forming outside flank (11*c*, 12*c*) having a fluting (13).

7. The dispenser according to claim 1 wherein said housing (B) includes a set of two diametrically opposed knobs (11, 12).

8. The dispenser according to claim 1 wherein a top end (1*b*) of said discharge duct (1) includes a spray nozzle.

9. The dispenser according to claim 1 wherein said discharge duct (1) radially clamps said tube (T).

* * * * *